US005631523A

United States Patent [19]

Rothenbuhler et al.

[11] Patent Number: 5,631,523

[45] Date of Patent: May 20, 1997

[54] METHOD OF REGULATING LAMP CURRENT THROUGH A FLUORESCENT LAMP BY PULSE ENERGIZING A DRIVING SUPPLY

[75] Inventors: Dan E. Rothenbuhler, Meridian; Samuel A. Johnson, Eagle, both of Id.

[73] Assignee: Beacon Light Products, Inc., Meridian, Id.

[21] Appl. No.: 531,037

[22] Filed: Sep. 19, 1995

Related U.S. Application Data

[63] Continuation of Ser. No. 530,563, Sep. 19, 1995, and a continuation of Ser. No. 530,673, Sep. 19, 1995.

[51] Int. Cl.[6] ..... G05F 1/00

[52] U.S. Cl. ..... 315/307; 315/289; 315/224; 315/103; 315/360

[58] Field of Search ..... 315/244, 224, 315/289, 290, 194, 103, 106, 107, 101, 283, 291, 360, 362, 209 R, 307

[56] References Cited

U.S. PATENT DOCUMENTS

| | | | |
|---|---|---|---|
| 4,107,579 | 8/1978 | Bodine, Jr. et al. | 315/205 |
| 4,165,475 | 8/1979 | Pegg et al. | 315/101 X |
| 4,329,627 | 5/1982 | Holmes | 315/209 R |
| 4,447,759 | 5/1984 | Moerkens et al. | 315/224 X |
| 4,870,340 | 9/1989 | Kral | 323/235 |
| 4,885,507 | 12/1989 | Ham | 315/244 |
| 5,004,960 | 4/1991 | Cockram et al. | 315/307 |
| 5,030,890 | 7/1991 | Johnson | 315/308 |
| 5,049,789 | 9/1991 | Kumar et al. | 315/289 |
| 5,396,152 | 3/1995 | Bönigk | 315/241 R |
| 5,477,109 | 12/1995 | Chermin et al. | 315/106 |
| 5,504,398 | 4/1996 | Rothenbuhler | 315/209 R |

FOREIGN PATENT DOCUMENTS

| | | |
|---|---|---|
| 46395 | 2/1982 | European Pat. Off. . |
| 197035 | 10/1986 | European Pat. Off. . |
| 471215 | 2/1992 | European Pat. Off. . |
| 471332 | 2/1992 | European Pat. Off. . |
| 2517211 | 10/1976 | Germany . |
| WOA9535646 | 12/1995 | WIPO . |

OTHER PUBLICATIONS

Co-pending Patent Application S.N. 08/404,880; Attorney Docket No. (083-321); filed Mar. 16, 1995.

Co-pending Patent Application S.N. 08/406,183; Attorney Docket No. (083-322) filed Mar. 16, 1995.

Co-pending Patent Application S.N. 08/530,563; Attorney Docket No. (083-323) filed Sep. 19, 1995.

Co-pending Patent Application S.N. 08/530,673, Attorney Docket No. (083-324); filed Sep. 19, 1995.

*Primary Examiner*—Robert Pascal
*Assistant Examiner*—Haissa Philogene
*Attorney, Agent, or Firm*—John R. Ley

[57] ABSTRACT

A method of regulating an operating current conducted from a source through a fluorescent lamp involves conducting a charging current from the source through an energy storage element of a resonator circuit to store a predetermined different degree of energy in the element than is stored by conduction of the operating current, and then releasing the stored energy to regulate the operating current delivered to the plasma within the lamp. The conductive time interval during which charging current flows is adjusted to regulate the lamp current to an optimal level for the best illumination efficiency from the lamp and the longest useful lifetime of the lamp. The conductive time interval is adjusted based on the voltage across the plasma. The known negative impedance characteristics of the plasma correlate the sensed voltage to the lamp current conducted by the plasma, thereby allowing regulation of the lamp current to the desired optimal level.

24 Claims, 5 Drawing Sheets

METHOD OF REGULATING LAMP CURRENT THROUGH A FLUORESCENT LAMP BY PULSE ENERGIZING A DRIVING SUPPLY

CROSS REFERENCE TO RELATED INVENTIONS AND APPLICATIONS

This is a continuation of U.S. patent application Ser. No. 08/530,563 for a "Resonant Voltage-Multiplication, Current-Regulating and Ignition Circuit for a Fluorescent Lamp+ filed Sep. 19, 1995, and Ser. No. 530,673 for a "Preheating and Starting Circuit and Method for a Fluorescent Lamp" filed Sep. 19, 1995.

This invention relates to fluorescent lamps and other similar types of discharge lamps. More particularly, this invention relates to a new and improved method of controlling the current through a fluorescent lamp to establish and regulate that current at an optimal level for illumination and longevity of the lamp.

This invention incorporates features described in U.S. patent application Ser. No. 08/258,007 for a "Solid State Starter for Fluorescent Lamp," filed Jun. 10, 1994; Ser. No. 08/404,880 for a Dimming Controller for a Fluorescent Lamp," filed Mar. 16, 1995; and Ser. No. 08/406,183 for a "Method of Dimming a Fluorescent Lamp," filed Mar. 16, 1995. This invention may also advantageously incorporate features described in U.S. Pat. No. 5,030,390 for a "Two Terminal Incandescent Lamp Controller," issued Jul. 9, 1991 and now reissued as U.S. Pat. No. Re 35,220. Furthermore, certain aspects of this invention may be advantageously accomplished by using the invention described in Ser. No. 08/257,899 for a "High Temperature, High Holding Current Semiconductor Thyristor," filed Sep. 9, 1994.

The inventions described in the preceding two paragraphs are assigned to the assignee of this present invention. The disclosures of all these applications are incorporated herein by this reference.

BACKGROUND OF THE INVENTION

The majority of fluorescent lamps require the use of an inductor known as a ballast. The ballast is connected in series with the lamp to prevent excess current from flowing through an ionized plasma of a lighted lamp. If the ballast did not limit the current flow through the lamp, the excessive current would prematurely consume the filaments or cathodes and the interior phosphorescent coating which converts photon energy from the ionized plasma into illumination, thereby decreasing the useable lifetime of the lamp.

Although the ballast is effective to reduce the lamp current to levels which result in reasonable lamp lifetimes, the effect of the series-connected ballast is to reduce the voltage available to energize the plasma. The general rule is that the operative working voltage of the plasma must be no greater than one half of the voltage available from the mains power supply driving the lamp (such as 110, 120 or 220 volts) for a simple reactor ballast to work satisfactorily.

In general, high illumination-efficiency fluorescent lamps require higher voltages to achieve the higher levels of illumination. These higher illumination-efficiency lamps generally require separate, costly and sizable power supplies to boost the power supply mains voltage to a usable level. Such separate power supplies frequently employ autotransformers to obtain the increased voltage. The separate power supplies also contribute to the cost of the high illumination efficiency fluorescent lamps.

In an attempt to increase the voltage to a level satisfactory for use with a high illumination-efficiency fluorescent lamps, resonant energy storage, voltage-boosting circuits have been used in conjunction with the ballast. The resonant voltage boosting circuits store energy from the power mains and release the stored energy to the lamp as an oscillating, resonant driving voltage which is greater than the voltage of the power mains. The resulting higher voltage makes it possible to ignite and operate the higher illumination efficiency fluorescent lamps.

While a resonant circuit is effective in raising the voltage applied to the lamp, the characteristics of the resonant circuit either prohibit or limit the ability of a conventional fluorescent lamp starter circuit, such as a "glow bottle," to start or ignite illumination from the lamp. Generally, a very high voltage spike or pulse is required to initially establish an ionized conductive plasma in the lamp, after which the ignited plasma is sustained by the normal operating voltages. The resonant energy storage circuit appears to diminish the effect of the high starting voltage pulse or may even prevent the generation of the high voltage starting pulse altogether. Separate starter circuits are therefore required, which add cost and complexity. Without the capability of reliably starting or igniting the fluorescent lamp, the practical benefits gained from the resonant energy storage voltage boosting circuit are diminished or completely eliminated.

It is with respect to these and other considerations that the improvements from the present invention have resulted.

SUMMARY OF THE INVENTION

In general, the present invention provides a new and improved method of regulating the current delivered from a source, such as a resonant energy storage circuit, and conducted through a conventional fluorescent lamp. The method of the present invention effectively regulates the lamp current to a level which provides optimal operating conditions without premature degradation or failure of the lamp. Furthermore, the current controlling method is also capable of increasing the driving voltage applied to the lamp to allow high illumination-efficiency fluorescent lamps to be driven from the mains power supply voltage. Further still the method of the present invention allows the lamp to be started or ignited reliably without the use of separate or additional starters.

In accordance with these aspects, a method of regulating an operating current conducted from a source through a plasma between cathodes of a fluorescent lamp according to the present invention comprises the steps of connecting an electrical energy storage element to the cathodes and the source, conducting the operating current in half-cycles through the plasma, and then for a predetermined conductive time interval less than the whole half-cycle period during which the of operating current conducted through the plasma, conducting a charging current from the source through the resonant circuit to store energy in the energy storage element to a predetermined different degree than energy is stored in the storage element by conduction of the operating current during the remaining portion of that half-cycle. The last step involves releasing the stored energy during a half cycle to regulate the operating current delivered to the plasma.

The conductive time interval during which the switch is conductive draws charging current source through the energy storage element. The energy added to the resonant circuit is delivered during subsequent half-cycles as a boosted voltage which increases the current flow through the plasma. Adjustment of the conductive time interval allows the current to be regulated to an optimal level to achieve the best illumination efficiency from the lamp while establishing the longest useful longevity of the lamp.

Preferably the conductive time interval is regulated or adjusted in relation to the voltage existing across the plasma at a predetermined consistent time period during each half-cycle of applied voltage. The negative impedance characteristics of the plasma allow the sensed voltage to be correlated to the current conducted by the plasma. Further yet, by the preferable technique of causing the conductive time interval to exist near the end of the applied current half-cycle, the advantageous features of allowing the decreasing current at the end of the applied current half-cycle to commutate a high holding current switch into a nonconductive state effectively generates the high voltage ignition pulse for starting the lamp.

A more complete appreciation of the present invention and its scope may be obtained from the accompanying drawings, which are briefly summarized below, from the following detailed description of a presently preferred embodiment of the invention, and from the appended claims which define the scope of this invention.

DETAILED DESCRIPTION

Figure 1:
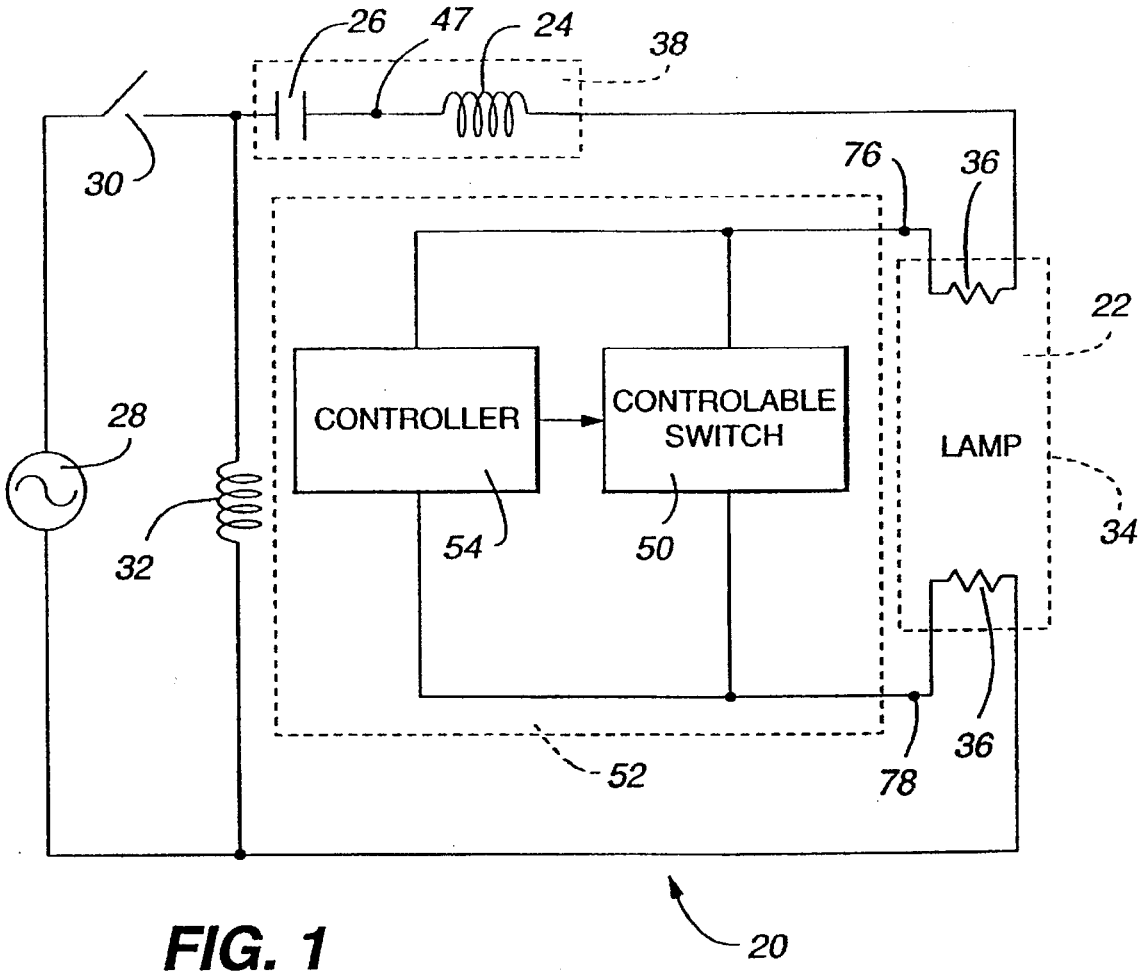
FIG. 1 is a simplified block and schematic circuit diagram of a fluorescent lamp circuit which incorporates a voltage boosting resonant circuit and a control module of the present invention, shown connected to a conventional AC power source and controlled by a manual switch.

The features of the present invention are embodied in a fluorescent lamp control circuit 20 shown in FIG. 1. The lamp control circuit 20 includes a fluorescent lamp 22, an inductor 24, known as a ballast, and a capacitor 26, all of which are connected in series. Conventional alternating current (AC) power from an AC source 28 is applied to the series connected lamp 22, inductor 24 and capacitor 26 through a power control switch 30, such as a conventional wall-mounted on/off power switch. An optional power factor correcting inductor 32 may be connected in parallel with the series connection of the inductor 24, capacitor 26 and lamp 22.

The fluorescent lamp 22 is conventional and is formed of an evacuated translucent housing 34. Two filament electrodes known as cathodes 36 are located at opposite ends of the housing 34. A small amount of mercury is contained within the evacuated housing 34. When the lamp 22 is lighted, the mercury is vaporized and ionized into a conductive medium, and current is conducted between the cathodes 36 through the ionized mercury medium creating a plasma. Energy from the plasma excites a phosphorescent coating inside the housing 34, and the illumination from the lamp results. Due to the well-known negative impedance conductivity characteristics of the plasma medium, the ballast 24 is necessary to limit the current flow through the plasma, thereby preventing the cathodes 36 from burning out prematurely.

Figure 2:
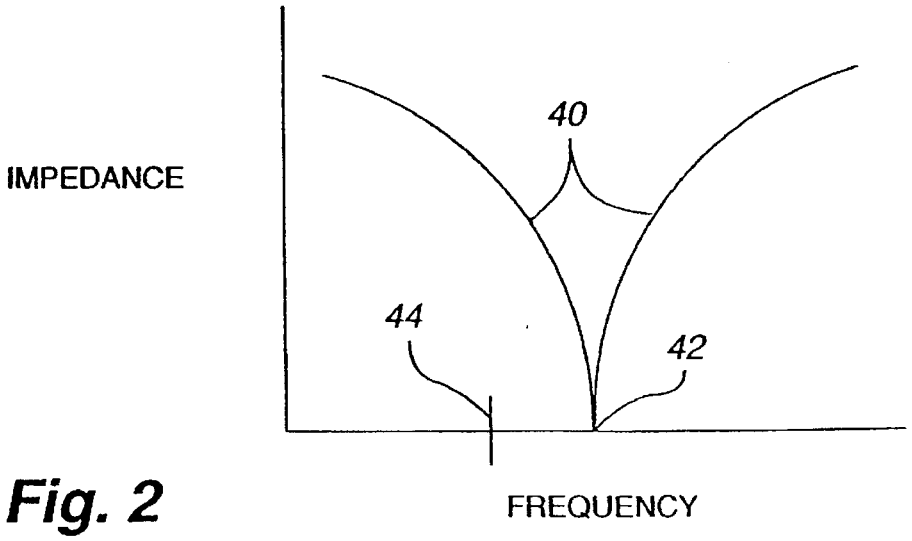
FIG. 2 is a graph of impedance relative to frequency of the resonant circuit shown in FIG. 1.

The inductor 24 and energy storage capacitor 26 form a resonant energy storage and voltage boosting circuit 38. The inductance and capacitive values of the inductor 24 and the capacitor 26, respectively, are selected to create a natural resonant frequency for the resonant circuit 38 which is different from the frequency of the AC power applied from the source 28. Curve 40 shown in FIG. 2 illustrates the impedance characteristic of the resonant circuit 38 relative to frequency. The impedance of the resonant circuit 38 has the least value at its natural resonant frequency 42. At frequencies on either side of the natural resonant frequency 42, the impedance of the resonant circuit 38 increases. The natural resonant frequency at 42 is preferably higher than the frequency 44 of the AC power source 28.

If the resonant frequency 42 is too close to the frequency 44 of the AC power source, the resulting impedance of the resonant circuit 38 would be too small to effectively limit the current to the cathodes 36 during normal operating conditions. Further, if the resonant frequency 42 is too far displaced from the frequency 44 of the AC power source, the resulting impedance would severely limit the voltage available for the lamp 22.

Figure 3:
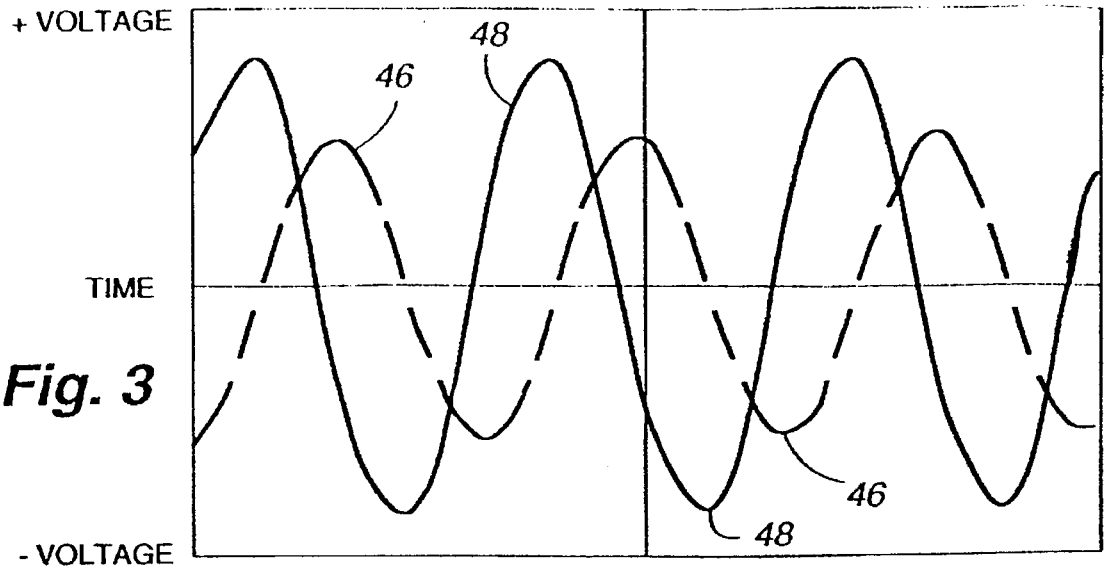
FIG. 3 is a waveform diagram showing the magnitude and phase relationship of an idealized AC voltage waveform delivered from the resonant circuit and an AC voltage waveform delivered from the AC power source.

The driving effect from the AC power source 28 predominates over the natural resonating characteristics of the circuit 38, and the output voltage from the resonant circuit 38 is maintained at the frequency 44 of the applied AC power from the source 28, as is shown in FIG. 3. The voltage from the AC source 28 is illustrated at 46, and an illustrative output voltage from a node 47 (FIG. 1) of the resonant circuit 38 is illustrated at 48. The frequencies of both signals 46 and 48 are identical. The relative phase of the two signals 46 and 48 is shifted due to the reactive nature of the resonant circuit 38.

Although the resonant circuit 38 does not oscillate at its natural frequency, the natural resonant frequency 42 is sufficiently close to the AC power source frequency 44 to provide significant energy storage capability at the frequency 44 of the source 28. The energy stored in the resonant circuit 38 has the effect of boosting or increasing the voltage supplied from the circuit 38. FIG. 3 also illustrates the boosted voltage resulting from the energy storage capability of the resonant circuit 38. The waveform 48 is an idealized representation of the output voltage from the resonant circuit 38 into a fixed impedance, which, of course, the fluorescent lamp is not, due to the periodic ignition and conductivity of the plasma within the housing 34. However, the comparison of the waveforms 46 and 48 illustrates the voltage boosting capability of the resonant circuit 38.

The output voltage 48 at the node 47 is greater than the output voltage 46 from the AC power source by an amount related to the energy stored in the resonant circuit. Viewed from the standpoint of node 47, the inductor 24 and the lamp 22 are driven with a higher voltage signal.

To store energy in the resonant circuit 38, which is thereafter released as the increased output voltage illustrated by the waveform 48, a controllable switch 50 draws current from the source 28 to energize the inductor 24 and capacitor 26, as is understood from FIG. 1. The controllable switch 50 is part of a control module 52, and the switch 50 is triggered by a controller 54 which is also part of the module 52. Since the impedance of the plasma of the lamp 22 is effectively removed from the circuit when the switch 50 is conductive, because the plasma is essentially short-circuited by the conductive switch 50, substantially all the voltage from the source 28 is applied across the resonant circuit 38.. The relatively low impedance characteristics of the resonant circuit 38, as shown in FIG. 2, causes more current flow through the resonant circuit 38 during a conductive time interval when the switch 50 is closed than during the time when the switch 50 is open or nonconductive. The energy from the increased current conducted through the resonant circuit 38 while the switch 50 is conductive is stored in the inductor 24 and capacitor 26. This increased current is hereinafter referred to as a charging current.

The conductive time interval is preferably caused to occur near the end of each half-cycle of applied AC current conducted through the lamp 22. The end of the half-cycle is preferably selected as the timing location for the conductive time interval to coordinate with the ability to reliably ignite or start the plasma in the lamp. The capability to ignite the plasma and start the lamp is described in detail in the previously mentioned U.S. patent application Ser. Nos. 08/258,007; 08/404,880 and 08/406,183.

In general, the capability to start the lamp is achieved by a high voltage pulse which is obtained from commutating the switch 50 into a nonconductive state as a result of the applied current transitioning through the zero crossing point at the end of an applied current half-cycle. By switching the conductive switch 50 into a conductive state during the conductive time interval at the end of the applied current half-cycle, the switch 50 is in a conductive state to be thereafter commutated into the nonconductive state and deliver the high voltage pulse starting capability.

Figure 4A:
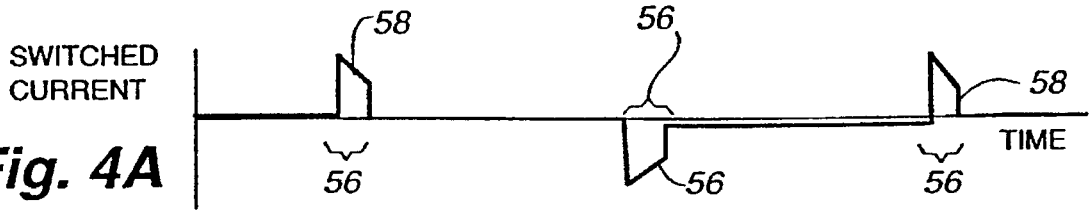
FIGS. 4A, 4B and 4C are waveform diagrams on an equivalent time axis of the current switched through the control module, the current conducted through the lamp and the voltage across the lamp, respectively, during operation of the fluorescent lamp circuit shown in FIG. 1.
Figure 4B:
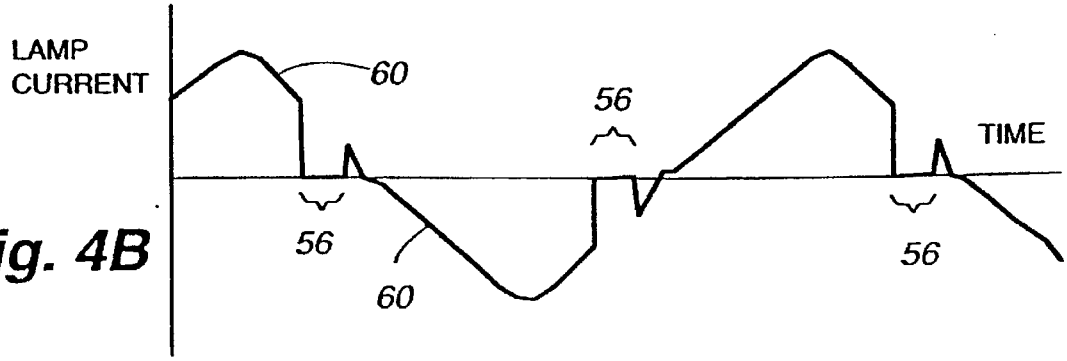

The conductive time interval during which the switch 50 is switched into the conductive state is referenced at 56 and is shown in FIG. 4A. During each conductive time interval 56, a pulse 58 of charging current is conducted through the switch 50 and the inductor 24 and capacitor 26. Each charging current pulse is timed to occur near the end of each half-cycle of the applied AC current 60 delivered to the lamp and conducted through the plasma between the cathodes in the lamp, as shown in FIG. 4B. During the conductive time interval 56, the lamp current 60 decreases to zero because the conductive switch 50 has diverted the current from the plasma by short-circuiting the cathodes 36. Under these conditions the plasma is extinguished because an insufficient voltage exists between the cathodes to sustain the plasma.

Figure 4C:
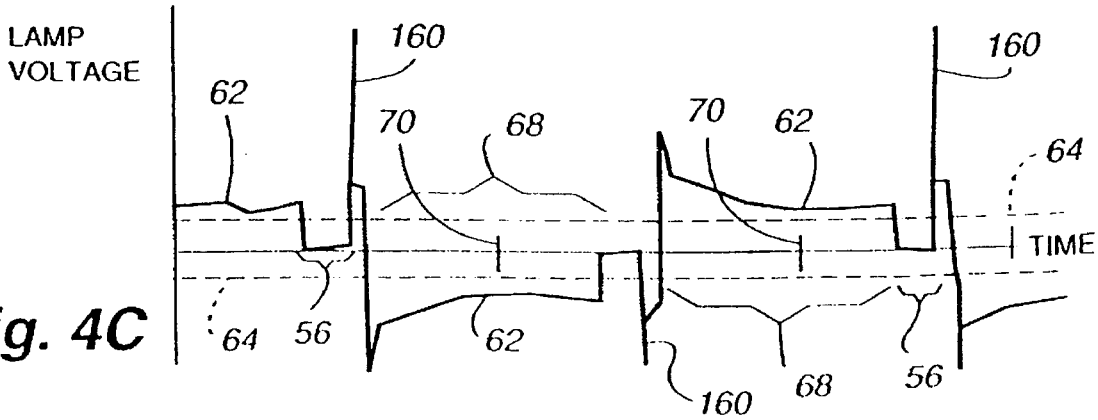

The lamp voltage 62 during the half-cycle of applied current is shown in FIG. 4C. Essentially the voltage 62 across the cathodes 36 of the lamp 22 remains at a characteristic operating voltage level 64 of the plasma during an illumination interval 68, until the conductive time interval 56 occurs. During the conductive time interval 56, the voltage drops to approximately zero while the cathodes are short circuited by the closed switch 50.

When the switch 50 is not operative, meaning that no current is diverted away from the plasma by the switch 50 being conductive, the lamp voltage 62 remains essentially at the operating level 64, even as the lamp current decreases to almost zero at the end of the applied current half-cycle. The decreasing lamp current near the end of the applied current half-cycle and the well-known negative impedance characteristics of the plasma (shown in FIG. 6) cause this result. As the lamp current decreases, the negative impedance characteristic of the plasma establishes a higher impedance through the plasma to help sustain the voltage across the plasma. Finally, when there simply is not enough energy left to sustain the voltage across the plasma, the plasma ceases to exist and the lamp extinguishes almost instantaneously and slightly before the current zero crossing point.

During the conductive time interval 56, the cathodes 36 are short circuited, and the lamp is extinguished. Because the conduction time interval 56 of the switch 50 prematurely extinguishes the plasma before the end of the applied current half-cycle, the illumination from the lamp is decreased by the effect of the extinguished plasma during the conduction time interval 56. The reduced illumination from the lamp may be counteracted by increasing the lamp current through the plasma during the illumination interval 68 when the plasma is ignited. The lamp current through the conductive plasma is increased by driving the lamp with a higher voltage derived from the resonant circuit 38. The higher voltage derived from the resonant circuit is related to the width of the conductive time interval 56. Adjusting the width of the conductive time interval 56 therefore also controls the current through the lamp. The increased current conducted through the lamp during the illumination interval 68 generally offsets the reduced illumination resulting from the switch 50 being conductive during the conductive time interval 56.

Controlling the lamp current 60 is the primary factor in obtaining the desired level of illumination performance from the lamp. Generally, the illumination level of a lamp is specified relative to an optimal level of operating current. Furthermore this optimal level of lamp current obtains the maximum useful longevity of the lamp. Excessive current greater than the optimal level will degrade the cathodes and have an adverse effect on the phosphorescent coating in the housing, thereby contributing to premature lamp failure.

Figure 5A:
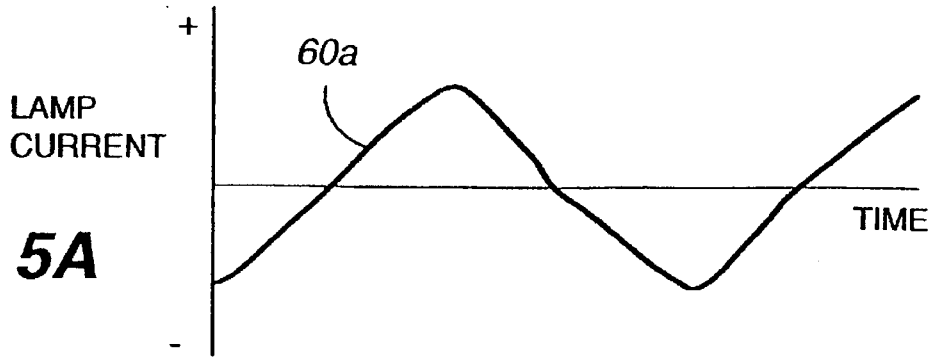
FIGS. 5A, 5B and 5C are waveform diagrams of the current conducted through the lamp shown in FIG. 1 when the control module is not operative, when the control module provides maximum energy storage and maximum voltage boost, and when the control module provides minimum energy storage and minimum voltage boost, respectively.
Figure 5B:
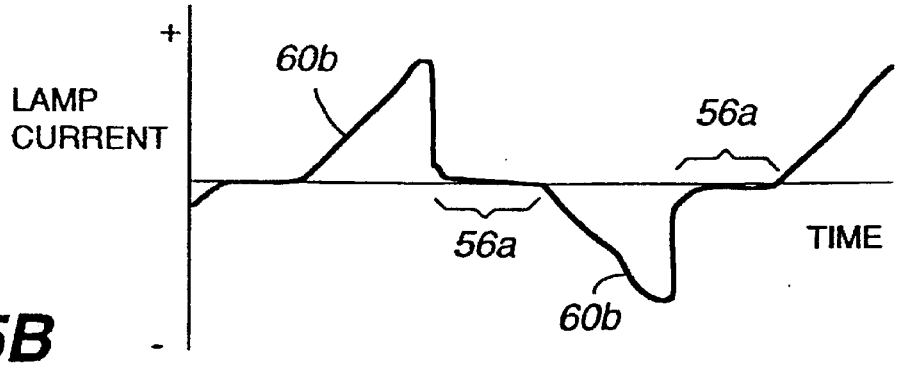
Figure 5C:
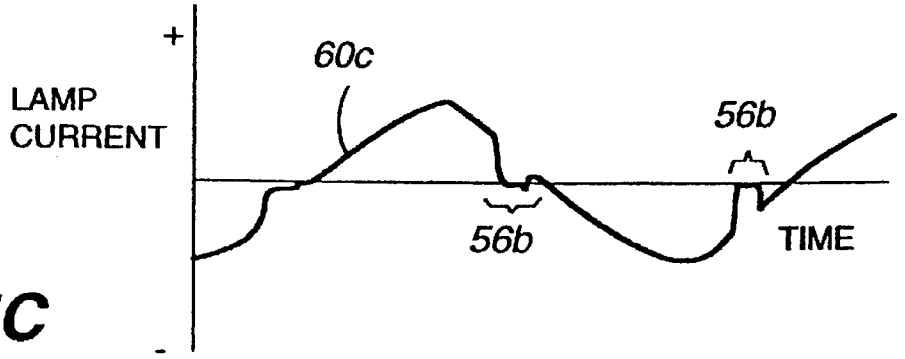

Control over the amount of charging current is determined by the point in time during each applied current half-cycle when the switch 50 is triggered, as is illustrated by FIGS. 5B and 5C. The curve **60*a* shown in FIG. 5A illustrates the normal or primary lamp current with its normal ramp-like increase and decrease when the controllable switch 50** is not triggered.

Figure 5D:
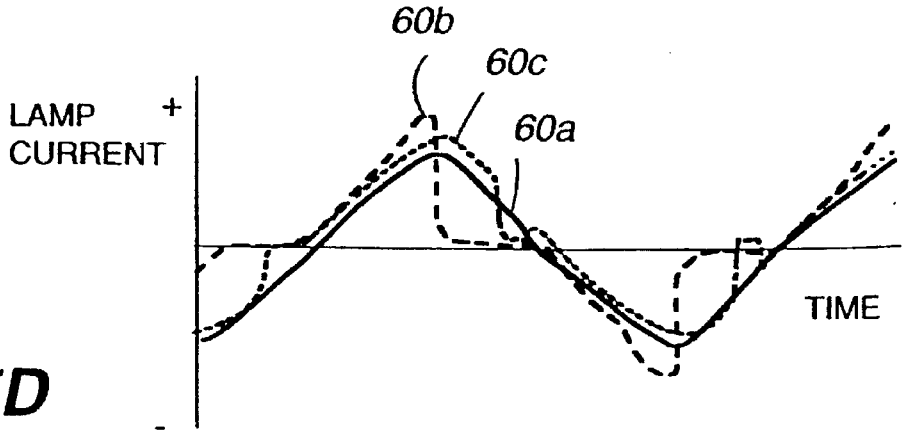
FIG. 5D is a graph of the waveforms of FIGS. 5A, 5B and 5C superimposed on one another for comparison purposes.

Curve **60*b* shown in FIG. 5B illustrates the situation where a maximum amount of charging current is conducted. The conduction time interval 56*a* of the switch 50 is relatively long, since the interval 56*a* occupies almost the last half of each applied current half-cycle, measured from the end of the half-cycle rearward in time. In general, the adjustment of the charging current will result in energy storage which is delivered in subsequent half-cycles after the charging current has energized the inductor. Therefore, as is shown in FIG. 5B, the lamp current 60*b* existing before the interval 56***a* occurs has increased substantially over the level of the normal lamp current 60*a* shown in FIG. 5A. This comparison is more readily understood by reference to FIG. 5D. The relatively long time width or duration of the conductive time interval 56*a* causes a larger or maximum amount of charging current 60*b* to be conducted through the resonant circuit 38.

In contrast, curve 60*c* shown in FIG. 5C represents the lamp current under an exemplary minimum conductive time interval 56*b*. The time interval 56*b* is substantially less in time duration or width than the conductive time interval 56*a*. Only a minimum amount of charging current is conducted through the resonant circuit. Even with a minimum amount of charging current, the lamp current 60*c* is still greater prior to the conductive time interval 56*b* than the lamp current 60*a* which exists when the conductive switch 50 is not operative, as is apparent from FIG. 5D.

By adjusting the conductive time interval 56 (56*a*, 56*b*) the current through the lamp is effectively controlled. Control over the lamp current allows its operating conditions to be more precisely established, thus obtaining the optimal operating conditions to achieve the desired level of illumination and to achieve a maximum useful lifetime from the lamp.

The width of the conductive time interval 56 is adjusted based on the variable input factor of the voltage existing across the cathodes at a predetermined fixed and constant time during each applied current half-cycle prior to the existence of the conductive time interval 56. The timing reference point for sensing the voltage is obtained by reference to the zero crossing points of the applied AC waveforms, for example at a consistent time point 70 shown in FIG. 4C. Sensing the voltage across the cathodes at this consistent time results in the ability to determine the lamp current flowing between the cathodes as well as whether the lamp is properly ignited.

Figure 6:
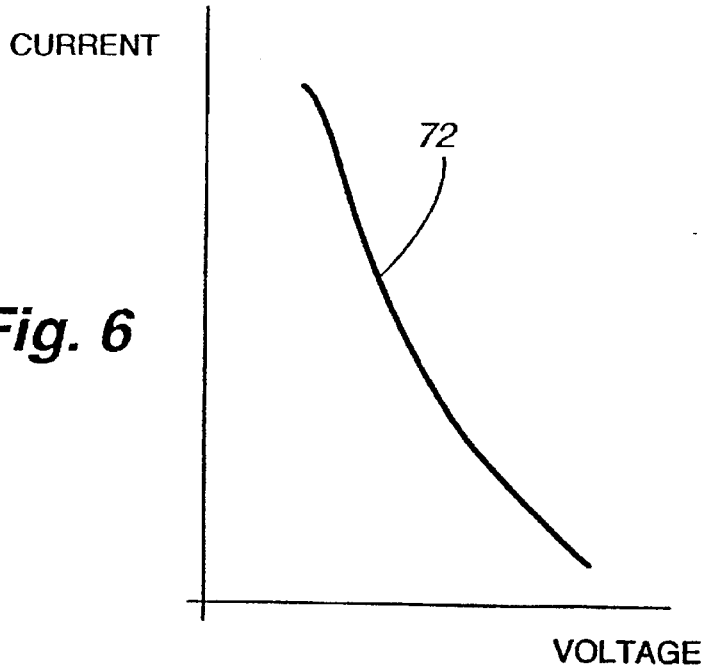
FIG. 6 is a graph of the impedance characteristic of a conductive plasma within the lamp shown in FIG. 1.

FIG. 6 illustrates the correlation between the voltage across the plasma and the current flowing through the plasma in a lighted fluorescent lamp. The impedance characteristic of the plasma, which is shown by the curve 72 in FIG. 6, is a negative characteristic, represented by the negative slope of the curve 72. The negative impedance characteristic illustrates that a decrease in current flowing between the cathodes results in an increase in voltage, and vice versa.

The control module 52 includes a memory which contains pre-programmed information which describes the impedance curve 72 of the plasma. By periodically sensing the voltage across the plasma on a consistent time basis, the resulting voltage measurement is directly related to the lamp current by use of the impedance curve 72. The resulting determination of the current is compared to a programmed and pre-established value for the optimal current for the lamp. If the actual lamp current is less than the pre-established optimal current value, the time width of the conductive time interval 56 is increased. Conversely, if the actual lamp current is greater than the pre-established optimal lamp current, the width of the conductive time interval is reduced. Of course, the typical feedback damping factors must be considered in this evaluation because the energy stored in the inductor 24 and capacitor 26 from the charging current is delivered during subsequent half-cycles, thereby causing a slight delay between the adjustments in the conductive time interval and the actual lamp current.

An alternative to using the voltage sensed across the plasma to control the current conduction through the lamp is to directly sense the lamp current. However, to do so requires the use of a current sensor and other hardware which adds to the cost of the module 52 and the circuit 20. Therefore, using the negative impedance characteristic to derive a value related to the current is preferred for cost purposes. The use of a current sensor as an alternative to measuring the voltage to control the lamp current is included within the scope of this invention.

Figure 8:
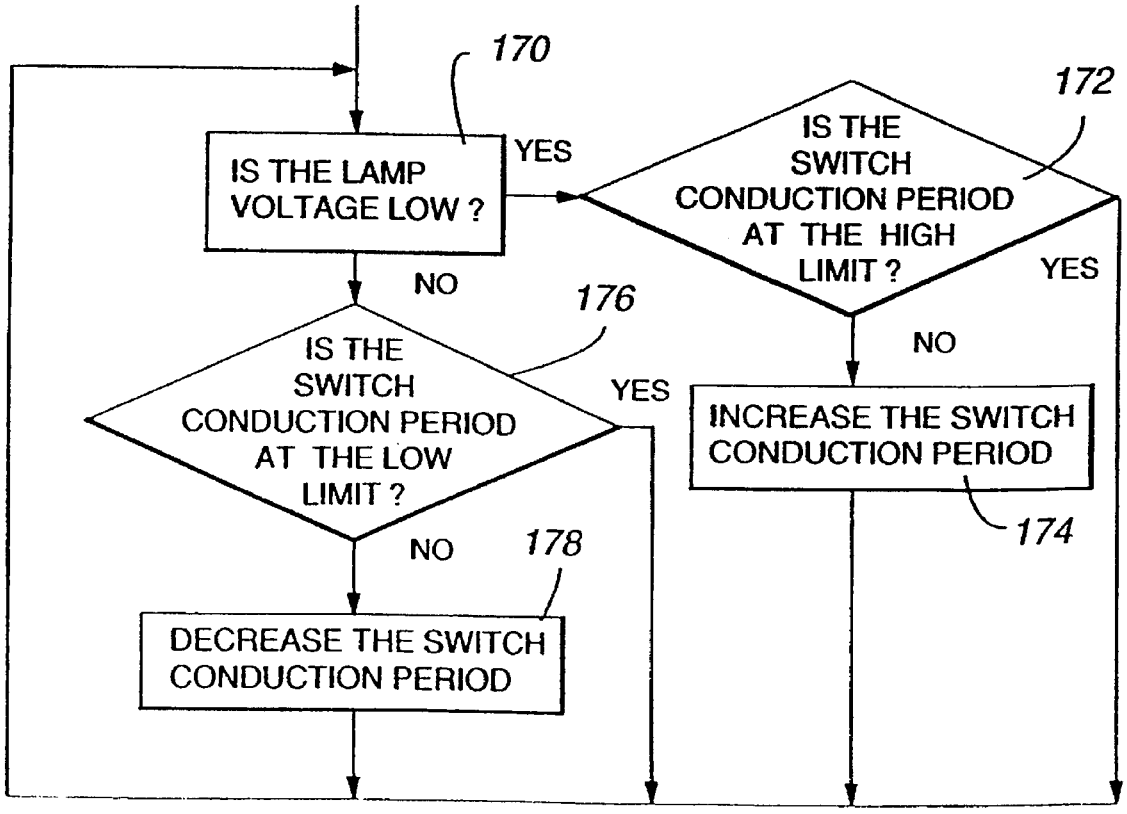
FIG. 8 is a flow chart of the sequence of operations performed by the control module shown in FIG. 1 to achieve the changes in current conducted through the lamp as illustrated in FIGS. 5B and 5C.
Figure 7:
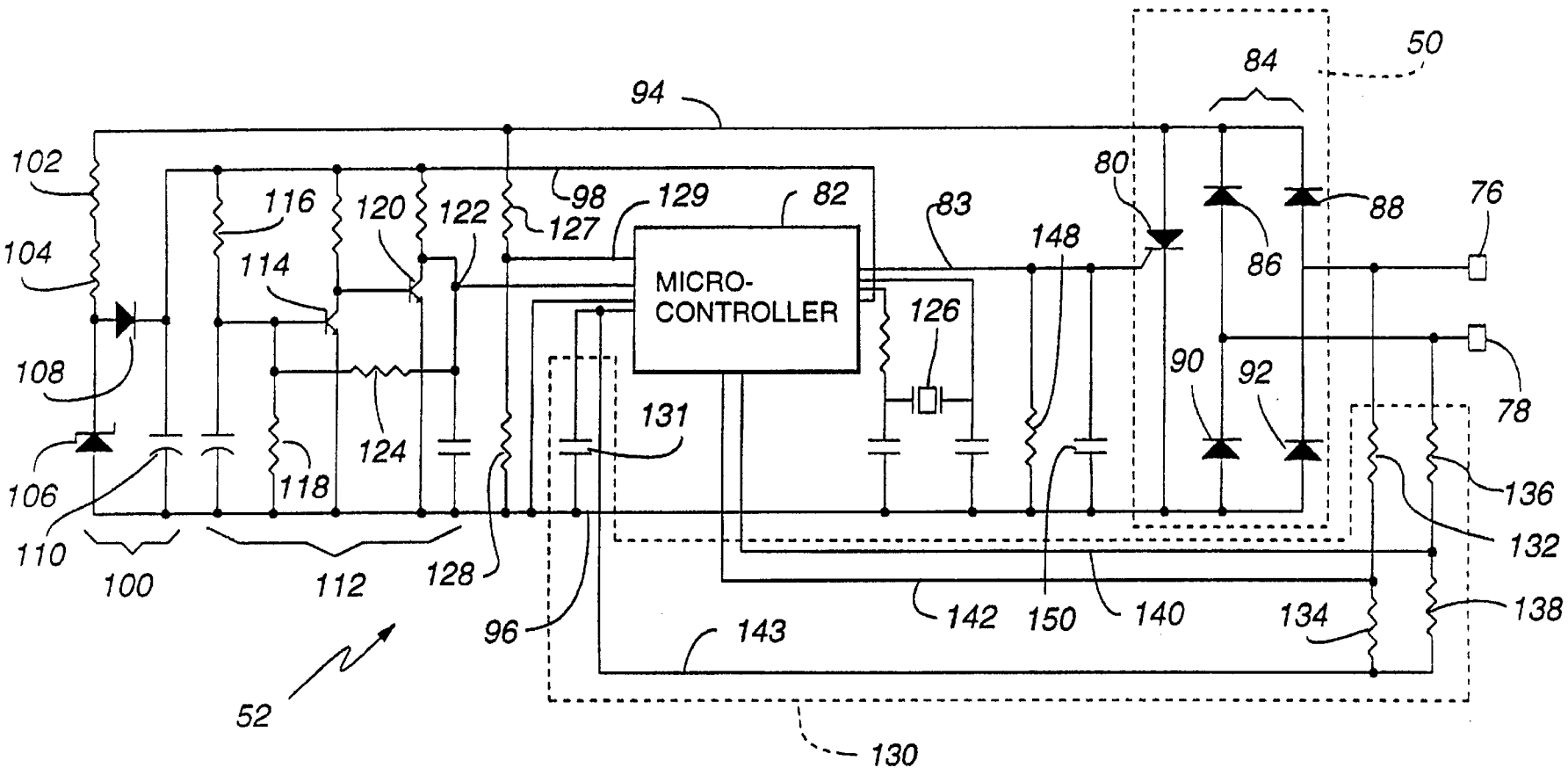
FIG. 7 is a schematic circuit diagram of the control module shown in FIG. 1.

The manner in which the control module 52 achieves the boosted driving voltage and the charging current, adjusts the time width of the conductive time interval 56, and senses the voltage between the cathodes, is more completely understood by reference to the schematic diagram of the module 52 shown in FIG. 7 and the flow chart shown in FIG. 8.

As shown in FIG. 7, the control module 52 is connected at terminals 76 and 78 to the lamp cathodes 36 (FIG. 1). The control module 52 includes many of the components of the solid state starter described in U.S. Patent Applications previously referred to above, including a high holding current thyristor, triac, or other type of semiconductor current switching device having the operational characteristics described in application Ser. No. 08/257,899. A SCR 80 is one example of such a controllable current switch 50.

A microcontroller 82, or other logic circuit or state machine, establishes the conductive time interval 56 by controlling the delivery of a trigger signal 83 to the SCR 80. The microcontroller 82 achieves these control functions in accordance with control information which has been pre-programmed into its memory (not shown). The memory of the microcontroller 82 also includes the information which describes the negative impedance characteristic of the plasma shown in FIG. 6, and the optimal current level for the lamp with which the module 52 is used. The program flow employed by the microcontroller 82 to adjust and control the conductive time interval and to trigger the SCR 80 into conduction is generally shown in FIG. 8.

A full wave rectifying bridge 84 is connected between the SCR 80 and the terminals 76 and 78. The rectifying bridge 84 is formed by diodes 86, 88, 90 and 92. The bridge 84 rectifies both the positive and negative half-cycles of applied current and applies a positive potential at node 94 and negative potential at node 96. The anode power terminal and the cathode power terminal of the SCR 80 are connected between the nodes 94 and 96. Conduction of the SCR 80 will conduct current through the lamp cathodes 36 during both the positive and negative half-cycles of the AC power, due to the steering or rectifying effect of the rectifying bridge 84. The SCR 80 and the rectifying bridge 84 are one example of the controllable switch 50 shown in FIG. 1.

DC power for the microcontroller 82 is supplied at node 98 by a power supply 100 which includes resistors 102 and 104, a voltage-regulating Zener diode 106, a blocking diode 108 and a storage capacitor 110. The storage capacitor 110 charges through the diode 108 to approximately the breakdown level of the Zener diode 106. The Zener diode 106 establishes the voltage level of the power supply 100 at the node 98. During power interruptions and zero crossings of the applied AC voltage, the blocking diode 108 prevents the storage capacitor 110 from discharging. The storage capacitor 110 holds sufficient charge to maintain the microcontroller 82 in a powered-up operative condition during the times of zero crossings of the applied AC power. Power for the module 52 is obtained from the terminals 76 and 78 when the SCR 80 is not conductive.

A reset circuit 112 is connected to the storage capacitor 110 for the purpose of disabling and resetting the microcontroller 82. The microcontroller 82 is disabled until the voltage across the storage capacitor 110 reaches the proper level to sustain reliable operation. The microcontroller 82 is reset when the power supply voltage across the storage capacitor 110 drops below that level which sustains reliable operation of the microcontroller.

The reset circuit 112 includes a transistor 114 which has its base terminal connected to a voltage divider formed by resistors 116 and 118. Until the power supply voltage across the storage capacitor 110 reaches a desired level, the voltage across the resistor 118 keeps the transistor 114 biased into a non-conductive state. When the transistor 114 is non-conductive, a transistor 120 is conductive, since the base of transistor 120 is forward biased by essentially any level of voltage at 98 which is greater than its forward bias voltage. With the transistor 120 forward biased, the voltage at node 122 is low. Node 122 is connected to a reset terminal of the microcontroller 82. While the voltage at the node 122 is low, the microcontroller 82 is held in a reset or inoperative state.

As the voltage across the power supply storage capacitor 110 increases, the voltage on the base of transistor 114 increases and eventually reaches the point where the transistor 114 starts to conduct. The conducting transistor 114 decreases the voltage at the base of transistor 120, causing transistor 120 to reduce its conductivity. The voltage at node 122 starts to rise, and this increasing voltage is applied by a feedback resistor 124 to the base of transistor 114. The signal from the resistor 124 is essentially a positive feedback signal to accentuate the effect of the increasing conductivity of the transistor 114. The positive feedback causes an almost instantaneous change in the conductivity characteristics of the transistors 114 and 120, resulting in an almost instantaneous jump in the voltage level at node 122. Consequently, the reset signal rapidly and cleanly transitions between a low and high level to establish an operative condition at the microcontroller 82. A similarly-acting but opposite-in-effect situation occurs when the voltage from the power supply capacitor 110 diminishes below the operating level of the microcontroller 82, due to the positive feedback obtained from the resistor 124.

A regulated frequency reference for the clock frequency of the microcontroller 82 is established by a crystal 126.

The voltage across the lamp at the cathodes 36 is sensed by a voltage sensing circuit which includes resistors 127 and 128 connected in series between the nodes 94 and 96. The resistors 127 and 128 form a voltage divider for reducing the magnitude of the voltage appearing between the nodes 94 and 96. The voltage between the nodes 94 and 96 is directly related to the voltage across the lamp because of the effect of the rectifying bridge 84. The connection point of the resistors 127 and 128 delivers a signal at 129 to a terminal of the microcontroller 82.

Adjustment of the values of the resistors 127 and 128 establishes a magnitude of the signal at 129 which can be directly used by the microcontroller 82. Furthermore, the microcontroller is preferably programmed to establish a single threshold value which is directly related to the magnitude of the the operating voltage level 64 (FIG. 4C) of the lamp. If the magnitude of the signal appearing at 129 is greater than the threshold established by the microcontroller 82, thereby indicating that the lamp voltage is greater than the desired operating level, the time width of the conductive time interval is reduced. A simple comparison of the signal at 129 with the programmed threshold establishes the basis for decreasing the time width of the conduction time interval 56. Conversely, if the signal at 129 is less than the programmed threshold, thereby indicating that the lamp is either not lighted or that the lamp voltage is low, the comparison of the signal 129 and the programmed threshold results in increasing the time width of the conduction time interval.

Although conventional analog to digital converters could be employed with the microcontroller to sense the lamp voltage more exactly, such converters add cost and complexity of the circuit. It is for the reason of reducing cost and complexity that the simple threshold comparison technique described in the preceding paragraph is employed to sense the voltage for controlling the time width of the conduction time interval. The present invention, however, encompasses the use of more sophisticated and complex techniques of sensing the lamp voltage, and/or the lamp current, to control the conduction time interval.

The control module 52 includes a zero crossing detection circuit 130. The zero crossing detection circuit 130 is formed by a capacitor 131 and resistors 132, 134, 136 and 138. Conductors 140 and 142 connect to the junction point of resistors 136 and 138 and to the junction point of resistors 132 and 134, respectively. The capacitor 131 references the signals on conductors 140 and 142 to the reference potential at node 96. The resistors 132, 134, 136 and 138 form voltage dividers for reducing the voltage at the terminals 76 and 78 to levels on conductors 140 and 142 which are directly used by the microcontroller 82.

The voltages on the conductors 140 and 142 are recognized by the microcontroller 82 to identify the zero crossings of the half-cycles of AC voltage, which are applied across the lamp cathodes connected to the terminals 76 and 78. The zero crossing points are employed to derive timing information for measuring the lamp voltage signal 129 at a predetermined time during each applied half-cycle of voltage.

The microcontroller 82 alternately connects one of the two conductors 140 and 142 to the reference potential at node 96 during successive half-cycles of current applied to the lamp. For example, during one half-cycle, the connector 140 is connected to the reference potential through the microcontroller. The microcontroller establishes a very high or infinite impedance on the other connector 142. Under these circumstances, a voltage divider exists through the resistors 132, 134 and 138. The junction of the resistors 136 and 138 is connected to the reference potential at the connector 140. A conductor 143, which is connected to the junction of resistors 134 and 138, supplies a signal from the resistors 132, 134, 136 and 138 to the microcontroller. The signal supplied on conductor 143 is a value related to and less than the voltage appearing on terminal 76, due to the voltage reducing effects of the voltage divider resistors 132, 134 and 138. When the voltage on terminal 76 transitions through the zero point, the microcontroller 82 recognizes this fact by comparing the signal level on conductor 143 with the reference potential at node 96.

Once the zero crossing point has been detected, the connection and impedance levels of the conductors 140 and 142 is reversed. The reversed or alternative state of the conductors 140 and 142 from the example started in the preceding paragraph is that conductor 142 is connected to the reference potential of node 96 and conductor 140 is placed at a high impedance level. The voltage from terminal 78 is applied to the resistors 136, 138 and 134, and the resulting voltage on the conductor 143 is representative of the voltage appearing across the lamp cathodes during this subsequent half-cycle. When the zero crossing point is recognized by the microcontroller, the impedance and connection states of the conductors 140 and 142 is again reversed.

The zero crossing detection circuit 130 causes the voltage applied at the conductor 143 to be positive. The voltage dividing resistors reduce the level of voltage from the terminals 76 and 78 to a value which can be directly used by the microcontroller. Furthermore a simple comparison of the voltage at the conductor 143 with the reference potential obtains a convenient and reliable determination of the zero crossing point. More complex and extensive techniques for determining the zero crossing point could be incorporated as a part of the present invention, but the technique disclosed offers simplicity and reliability without substantial additional cost.

By sensing the voltage magnitude at the predetermined fixed time points 70 (FIG. 4C) during each applied half-cycle of voltage, the plasma voltage sensed is directly correlated to the current flowing through the plasma by the curve 72. Information concerning the curve 72 is programmed into the microcontroller 82. By reference to the programmed information defining the negative impedance characteristic curve 72, the microcontroller determines the current flow through the lamp. If more current flow is desired, the amount of charging current conducted through the resonant circuit 38 (FIG. 1) is increased by increasing the conductive time interval 56 shown in FIG. 5B. The increased charging current boosts the output voltage 48 (FIG. 3) from the resonant circuit. Conversely, if less current flow is desired, the amount of charging current conducted through the resonant circuit is decreased, thereby decreasing the magnitude of the output voltage 48 from the resonant circuit 38.

Adjustments in the charging current for the resonant circuit 38 are achieved by varying the conductive time interval 56 when the SCR 80 is conductive. The time interval 56 during which the SCR 80 is conductive is established by the microcontroller 82 and is based on the voltage signal sensed at 129 and on the information which describes the negative impedance characteristic curve 72 of the lamp plasma.

The trigger signal 83 controls the conductivity of the SCR 80. The microcontroller 82 establishes the time point at which the trigger signal 83 is delivered to the gate terminal of the SCR 80, to thereby initiate the start of the conductive time interval 56. A resistor 148 and a capacitor 150 form a filter for the pulse-like trigger signal 83. In response to the trigger signal 83, the SCR 80 becomes conductive. The conductivity of the SCR 80 draws current through the cathodes 36 (FIG. 1). The rectifying effect of the bridge 84 causes current to flow through the cathodes regardless of the polarity of the half-cycle of the applied AC driving voltage.

The program flow for adjusting the time interval of conduction of the SCR 80 to achieve the regulation of the charging current, and hence the adjustment of the operating conditions of the lamp, is illustrated in FIG. 8. After sensing the voltage between the lamp cathodes 36 at the point 70 (FIG. 4C), the sensed voltage is evaluated to determine whether it is low, as shown at 170. If the voltage is low, a determination is made at 172 whether the high limit switch conduction period (conductive time interval 56) for the SCR is in effect. The high limit switch conduction period is represented by the maximum allowable conductive time interval 56*a* shown in FIG. 5B. If the high limit switch conduction period 56*a* is present, the sequence returns to the beginning of the program flow illustrated in FIG. 8. If not, the conductive time interval 56 is increased as shown at 174. After the conductive time interval has been increased, the sequence returns to the beginning where the lamp voltage is again sensed at 170. If the lamp voltage continues to remain low, the steps 172 and 174 are again repeated until the lamp voltage reaches the desired level.

When the lamp voltage is not low as sensed at 170, another determination is made at 176 to establish whether the switch conduction period (conductive time interval) 56 is at the low limit. The low limit of the minimum conductive time interval is represented at 56*b* in FIG. 7C. If the low limit conductive time interval exists, the sequence returns to the beginning.

However, if the low limit conductive time interval 56*b* does not exist, the conductive time interval is decreased as shown at 178. Thereafter the sequence returns to the beginning. The flow sequence described continues to repeat with adjustments in the conduction time interval 56 to provide the appropriate amount of voltage boost to the lamp to achieve the optimal and desired current flow through the lamp.

Referring back to FIG. 7, after the trigger signal 83 is delivered by the microcontroller 82 to the SCR 80, a high impedance is established at the output terminal of the microcontroller 82 from which the trigger signal 83 is delivered. The high output impedance prevents a drain of the current from the gate terminal of the SCR 80. By eliminating current drain from the SCR gate terminal, the charge on the storage capacitor 110 is preserved. Thereafter, shortly before the end of the time interval 56 during which the charging current is drawn through the resonant circuit 38, the impedance at the gate terminal of the SCR 80 is lowered. The low gate terminal impedance of the SCR 80 conducts gate current from the SCR, which results in an increased holding current.

The holding current of the SCR 80 is a characteristic current value which represents that amount of current which the SCR must conduct through its power terminals (the anode and cathode are connected to nodes 94 and 96, respectively) to maintain a conductive state of the SCR. If the anode-cathode current falls below the holding current value, the SCR will immediately commutate into a non-conductive state.

Establishing a relatively high holding current for the SCR 80 near the end of the conductive time interval 56 (56*a*, 56*b*) creates a relatively high voltage starting pulse for igniting the plasma during the next subsequent half-cycle of applied AC voltage. This advantageous characteristic is described in detail in the application Ser. No. 08/258,007. In general, however, the high holding current of the SCR 80 causes a sufficient amount of current to flow through the SCR when it commutates to a nonconductive state. With the relatively high holding current, and the relatively instantaneous commutation to the nonconductive state, a relatively high change in current per change in time (di/dt) results.

The di/dt effect from the commutation of the SCR 80, or any other high holding current triac or thyristor, causes the inductor 24 to respond by generating a high voltage pulse 160 shown in FIG. 4C. The high voltage pulse 160 may be three to five times the normal voltage 48 (FIG. 3) applied by the resonant circuit 38. The high voltage pulse is sufficient to ionize the medium into the conductive plasma. Once conductivity is established in the medium, the applied voltage 48 (FIG. 3) is sufficient to maintain the plasma state, even between subsequent applied half-cycles where the plasma is momentarily extinguished when the applied voltage falls below the operating voltage level 64.

Furthermore, as is discussed in greater detail in the concurrently filed U.S. patent application Ser. No. 08/530,673 and in the previously filed application Ser. No. 08/258,007, a cold start of the lamp requires or makes it desirable that the cathodes 36 (FIG. 1) be warmed. The cathodes must be sufficiently heated to emit ions to initially establish a conductive medium surrounding the cathodes in order to initially start the lamp. The control module 52 (FIG. 1) is capable of heating the cathodes by conducting the current through the cathodes when the SCR 80 is conductive, in the same manner as is described in application Ser. No. 08/258,007.

Further still, the application Ser. Nos. 08/404,880 and 08/406,183 describe how to dim or otherwise control the intensity of illumination from a fluorescent lamp by triggering a thyristor, triac or SCR near the end of the time interval during each half-cycle. This has the effect of reducing the time interval of illumination during each half-cycle, thus dimming the lamp. Because of the starting capabilities available from the high voltage starting pulse, the lamp can be reliably ignited on the next subsequent half-cycle of applied voltage. This dimming capability may also be advantageously integrated into the functionality associated with the control module 52 of the present invention.

Higher illumination efficiency lamps can be used as a result of the present invention, and higher levels of illumination are obtained, without employing more expensive autotransformers and complex electronic ballasts. The lamp operating current is closely regulated to achieve optimum operating conditions. The lamp is reliably started using essentially the same equipment which is programmed to achieve the beneficial voltage-boosting and current-regulating effects. Further still, this same equipment may be programmed to achieve the additional feature of dimming or illumination control over the fluorescent lamp. Numerous other advantages and improvements result from the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

The invention claimed is:

1. A method of regulating an operating current conducted through a plasma between cathodes of a fluorescent lamp while the lamp is continuously lighted by energy supplied from an AC electrical source, the source delivering AC source current at a predetermined source frequency in half-cycles having a periodic half-cycle interval established by the source frequency, said regulating method comprising the steps of:

connecting a resonant circuit including at least one electrical energy storage element in series in a current path through the plasma and the cathodes and the source;

conducting half-cycles of primary source current to the resonant circuit during each entire periodic half-cycle interval;

storing a normal amount of energy in the resonant circuit during each periodic half cycle interval as a result of conducting the primary source current to the resonant circuit;

deriving the operating current from the energy stored in the resonant circuit;

conducting the operating current through the plasma during lamp illumination intervals which occur at the same predetermined frequency as the half-cycles of the primary source current;

during a predetermined conductive time interval of a duration less than the entire periodic half-cycle interval of each half-cycle of primary source current, conducting a charging current in addition to the primary current from the source to the resonant circuit, the charging current storing additional energy in the resonant circuit in a predetermined amount greater than that normal amount of energy stored in the resonant circuit by the primary source current;

releasing the additional stored energy along with the normal stored energy as operating current during a lamp illumination interval occurring after the half cycle in which the charging current was conducted and the additional energy was stored to regulate the operating current delivered to the plasma; and performing said steps during each half-cycle and lamp illumination interval while the lamp is lighted.

2. A method as defined in claim 1 further comprising the step of:

releasing the additional stored energy over a plurality of lamp illumination intervals.

3. A method as defined in claim 1 further comprising the step of:

adjusting the time duration of the conduction time interval to vary the amount of operating current conducted during the lamp illumination intervals.

4. A method as defined in claim 3 further comprising the step of:

adjusting the time duration of the conduction time interval occurring during each of a plurality of subsequently occurring half-cycles of primary source current.

5. A method as defined in claim 3 further comprising the steps of:

sensing a voltage across the cathodes during the lamp illumination interval; and adjusting the conduction time interval in relation to the voltage sensed.

6. A method as defined in claim 5 further comprising the step of:

sensing the voltage across the cathodes a predetermined consistent time point during the occurrence of each of a plurality of lamp illumination intervals.

7. A method as defined in claim 1 further comprising the step of:

short circuiting the cathodes for the conductive time interval to increase the current flow from the source to the resonant circuit by the amount of the charging current.

8. A method as defined in claim 1 further comprising the step of:

forming the resonant circuit by connecting a capacitor and an inductor, and the energy storage element is at least one of the capacitor or the inductor.

9. A method as defined in claim 8 further comprising the step of:

connecting the capacitor and the inductor in series in the resonant circuit.

10. A method as defined in claim 9 wherein the inductor has a characteristic saturation current, and the sum of the primary source current and the charging current is less than the saturation current.

11. A method as defined in claim 1 further comprising the step of:

timing the conductive time interval to occur at the end of the lamp illumination interval.

12. A method as defined in claim 11 further comprising the step of:

delivering a high voltage pulse to the plasma at the end of the lamp illumination interval.

13. A method as defined in claim 3 further comprising the steps of:

sensing a voltage across the cathodes during the lamp illumination interval; and adjusting the conduction time interval based on a predetermined relationship between the voltage sensed and an impedance characteristic of the plasma.

14. A method as defined in claim 1 further comprising the step of:

decreasing an impedance between the cathodes below a value of a characteristic impedance of the plasma for the conductive time interval to increase the current flow from the source to the resonant circuit by the amount of the charging current.

15. A method as defined in claim 1 further comprising the step of:

decreasing an impedance within the series current path formed by the resonant circuit and the cathodes and the plasma for the conductive time interval to increase the current flow from the source to the resonant circuit by the amount of the charging current.

16. A method as defined in claim 15 further comprising the step of:

timing the conductive time interval to be equal to the difference between the lamp illumination interval and the periodic half-cycle interval.

17. A method as defined in claim 1 further comprising the step of:

timing the conductive time interval to be equal to the difference between the lamp illumination interval and the periodic half-cycle interval.

18. A method as defined in claim 1 wherein the resonant circuit has a predetermined natural resonant frequency, and said method further comprises the step of:

establishing the natural resonant frequency at a predetermined frequency which is different from the predetermined source frequency.

19. A method as defined in claim 18 wherein the natural resonant frequency is greater than the predetermined source frequency.

20. A method as defined in claim 18 further comprising the step of:

selecting the natural resonant frequency to establish an impedance of the resonant circuit sufficient to limit the operating current conducted by the cathodes to a predetermined value selected to achieve substantially optimum longevity of use of the lamp.

21. A method as defined in claim 18 wherein the resonant circuit has a predetermined energy storage capability, and said method further comprises the step of:

selecting the energy storage capability of the resonant circuit to accept more than the normal and additional amounts of energy.

22. A method of increasing the magnitude of an operating current conducted through a plasma existing between cathodes of a fluorescent lamp during continuously-occurring illumination intervals of the lamp, comprising the steps of:

connecting a resonant circuit including at least one electrical energy storage element in series with a current path through the plasma and the cathodes and an electrical source which supplies energy to illuminate the lamp;

conducting an energizing current in half-cycles from the source to the resonant circuit to store energy in the resonant circuit;

deriving the operating current from the energy stored in the resonant circuit;

conducting the operating current through the plasma for a first predetermined lamp illumination time interval which is less than the whole of each half-cycle of energizing current;

ceasing conducting the operating current through the plasma during a second predetermined time interval which is less than the whole of each half-cycle of energizing current;

storing a predetermined additional amount of energy in the resonant circuit by increasing the magnitude of the energizing current supplied by the source to the resonant circuit during the second predetermined time interval; and releasing the additional stored energy simultaneously with the energy stored from the energizing current delivered during the first interval as an increased operating current during an illumination time interval occurring subsequently after the storage of the additional amount of energy and during continuous operation of the lamp.

23. A method as defined in claim 22 wherein the additional energy is greater than that amount of energy stored in the resonant circuit by the source under a condition where the first illumination interval occupies the entirety of each half-cycle of energizing current.

24. A method as defined in claim 22 wherein the first and second intervals consume the entirety of the interval of each half-cycle of energizing current conducted from the source.

* * * * *